US007801459B2

(12) United States Patent
Huber et al.

(10) Patent No.: US 7,801,459 B2
(45) Date of Patent: Sep. 21, 2010

(54) HANDICAP ACCESSIBLE OFFICE PRODUCTS

(75) Inventors: Scott M. Huber, Canandaigua, NY (US); Dawn M. Hess, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 743 days.

(21) Appl. No.: 11/823,549

(22) Filed: Jun. 28, 2007

(65) Prior Publication Data

US 2009/0002725 A1 Jan. 1, 2009

(51) Int. Cl.
*G03G 15/00* (2006.01)

(52) U.S. Cl. ..... 399/81; 399/107

(58) Field of Classification Search ..... 399/81, 399/107, 110; 715/740
See application file for complete search history.

(56) References Cited

U.S. PATENT DOCUMENTS

| | | | | |
|---|---|---|---|---|
| 5,870,647 | A * | 2/1999 | Nada et al. | 399/18 |
| 6,748,186 | B1 * | 6/2004 | Skrainar et al. | 399/81 |
| 7,693,449 | B2 * | 4/2010 | Kaseno et al. | 399/107 |
| 2006/0204253 | A1 * | 9/2006 | Mae et al. | 399/16 |
| 2008/0219689 | A1 * | 9/2008 | Lang et al. | 399/81 |

* cited by examiner

*Primary Examiner*—David M Gray
*Assistant Examiner*—Rodney Bonnette
(74) *Attorney, Agent, or Firm*—James J. Ralabate

(57) ABSTRACT

This is a system which is adapted to make it easier for a wheelchair occupant to operate a marking system. There is a lowering device that lowers the module or modules to a location convenient to the wheelchair user. The modules ideally are on the same vertical plane or to a low plane selected by the user. Also, there is a horizontally positioning device that can move the modules to any preferable location.

14 Claims, 5 Drawing Sheets

HANDICAP ACCESSIBLE OFFICE PRODUCTS

The present invention relates to office products including marking systems and, more specifically, to office products that are improved for use by handicapped or disabled persons.

Illustrated and disclosed in co-pending application ID 20070156Q entitled "Handicapped Accessible Removable Control Panel" and owned by the same assignee as the present application is material relating to use of a marking machine by handicapped people. In ID 20070156Q, material is disclosed on the use of a Removable Control Panel to control and access functions of a marking machine. ID 20070156Q and the present application are filed concurrently herewith. The disclosure of ID 20070156Q is totally incorporated herein by reference.

BACKGROUND

For clarity, the present invention will be described in relation to an electrostatic marking system such as printers, facsimile, copiers, multifunctional machines and the like. However, the concepts and embodiments defined herein can easily be adapted for use in other office or other general products; these are intended to be included within the spirit of this invention.

By way of background and introduction, the following describes the basics of an electrostatic marking system.

In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface, the photoconductive insulating surface may be discharged and cleaned of residual toner to prepare for the next imaging cycle. This defined electrostatic system and reproducing apparatus is known as the Image Output Terminal (I.O.T.) or Processor Module.

When handicapped people in wheelchairs use office equipment such as electrostatic marking systems, certain difficulties have been observed. The height of the printer (or copier or fax) makes it difficult for the handicapped person to reach many components including the top platen glass. The low paper tray locations below the Image Output Terminal (hereinafter I.O.T.) or processor module make it almost inaccessible to handicapped people who have trouble bending down or stretching. Even just placing an original document on top of the platen can be a task for people in wheelchairs, etc. Today, it is virtually impossible for a person in a wheelchair to access all copier functions including the document handler or paper trays that need to be frequently loaded.

SUMMARY

Currently, the paper trays for some office products are located under the processor module or I.O.T. If the paper trays were located to the side of the unit, the unit would have approximately two feet below that could accommodate height adjusters that provide automatic (as opposed to Manual means) adjusting means such as an automatic supporting scissors-jack or a hydraulic lift can be used. These adjusting means could be controlled so that a disabled person could lower the machine to reach the document handler or the glass platen top or any machine component that is located on the upper part and lower part of the machine. The paper trays would be more easily accessible for a handicapped person if they were brought up to the current level of the I.O.T. and located to the side of the I.O.T.

The present invention provides a new configuration for office product devices such as printers, copiers, duplicators, etc. such that the system would be much more accessible for handicapped persons. The paper trays would be adjacent to the processor module side by side for easier access especially for persons in wheelchairs. A further enhancement would be height adjusters such that the height would be optimal for paper loading and for platen glass height or document handler height. The height of both the I.O.T. and the paper trays would be automatically adjustable by an adjusting bottom or the like. Also, the entire unit(s) or modules can be moved horizontally as well as vertically as shown in the drawings. This reconfiguration with the height adjustability for improved accessibility and lateral adjustment is to help the handicapped with machine accessibility. A scissors-jack mechanism with electric motor or a hydraulic lift or any other suitable lifting and lowering devices can be used. The horizontal adjuster can preferably be retractable tracks upon which the entire machine can move. Obviously, any suitable horizontal adjuster can be used. After the desired horizontal location is reached, the tracks will retract out of the way.

The paper trays are at the same level as the Image Output Terminal (I.O.T.) or referred to herein as the processor module. The level of all machine modules like the paper tray and I.O.T. are automatically raised or lowered by placing buttons (or other suitable devices) on the side or sides of the modules. One button can be for automatic raising and lowering and the second button can be for horizontal movement as shown in FIG. 5 of the drawings in this disclosure. The modules ideally are at a plane extending from just below the user's knees (in a sitting position) to up to the user's chest. The raising and lowering device must be able to lower the processor and the paper trays modules to a low position to permit a wheelchair occupant easy access to the paper trays and the processor.

The embodiments of this disclosure include at least two modules such as a first module, the I.O.T. and a second module, the paper trays. A third module could be a finishing station. As many modules can be used as needed; each of the modules can be vertically and optionally horizontally movable. The vertical (raising and lowering) movement is vital to provide a wheelchair user better access to the components of the modules. The modules can be attached to each other and movable as one piece or they can be detached and each with their own moving devices, i.e. scissors-jacks, hydraulic lift, horizontal mover, etc. They can also remain at or be returned to normal levels or locations for use by non-disabled people.

"Components" as used in this disclosure means parts of the system. "Modules", however, does not mean the same as "components"; "modules" mean throughout this disclosure functional units of the marking structure such as an I.O.T.

module, a paper tray module, a finisher module, etc. The vertical and horizontal adjusters are "components" and not "modules."

DETAILED DISCUSSION OF DRAWINGS AND PREFERRED EMBODIMENTS

Figure 1:
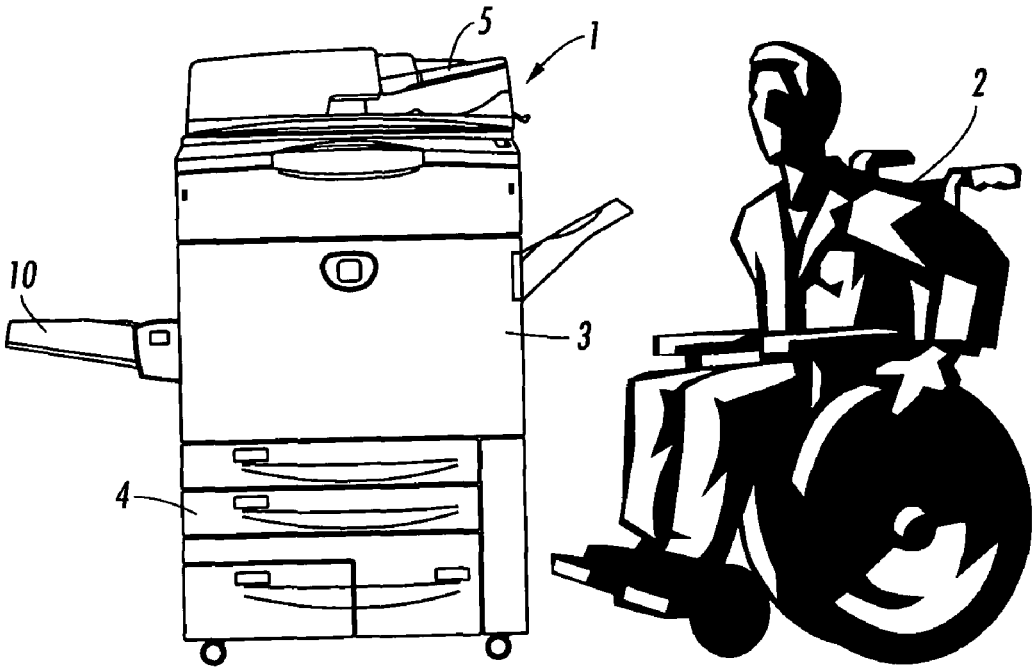
FIG. 1 PRIOR ART
FIG. 1 illustrates a prior art marking machine and shows the difficulty a wheelchair occupant has accessing this prior art machine.

In FIG. 1, a standard prior art marking machine 1 is shown with certain operational difficulties for a wheelchair user 2 as can be observed from the drawing. The usual arrangement is for the I.O.T. module 3 to be located above the paper trays module 4. Not only is it difficult for the wheelchair user to reach the platen or paper feed 5 but it is equally difficult for him or her to bend down to fill or refill the paper trays 4. These difficulties are magnified when and additional modules other than the I.O.T. module and paper trays module are added to the structure.

Functions and operations that are convenient and easy for non-handicapped present a problem to people in a wheelchair such as using the platen, lifting the platen cover, loading the paper trays, retrieving copies, feeding multiple copies, etc.

Figure 2:
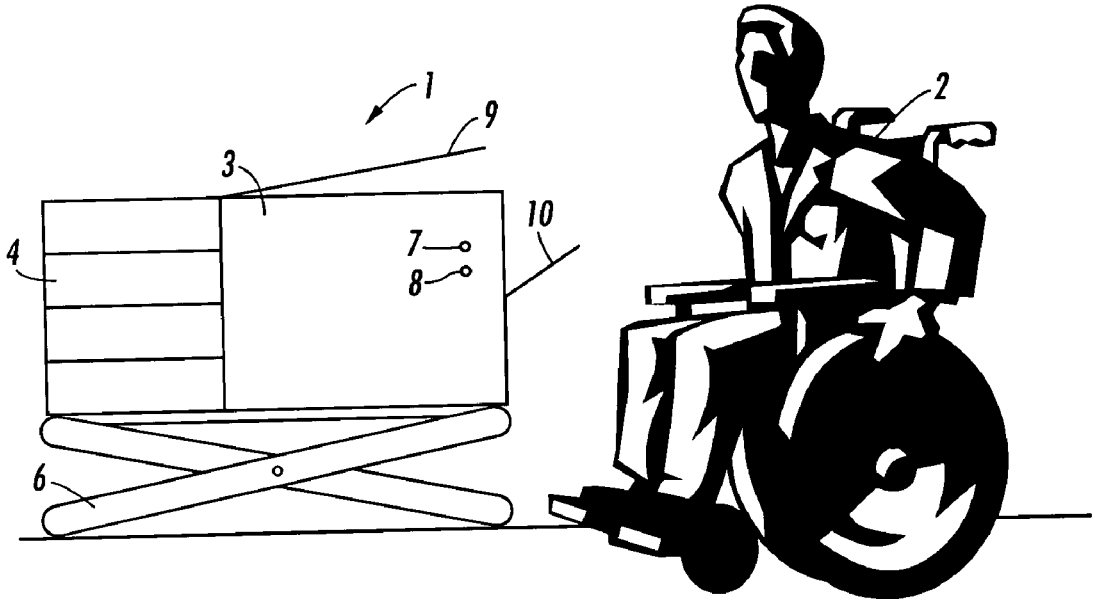
FIG. 2 illustrates a scissor-jack lift side view embodiment of this invention with at least two modules and how much easier access is for a wheelchair occupant.

In FIG. 2, an embodiment of this invention is shown where the I.O.T. module 3 and the paper tray module 4 are on the same vertical level, i.e. side by side rather than in an arrangement where the paper trays 4 are below the I.O.T. or processor module 3 as shown in the usual prior art arrangement of FIG. 1. A raising and lowering device 6, in this case a conventional or modified scissors-jack 6, connected to a motor (not shown), is used to automatically lower the entire structure to the desired level of the wheelchair occupant 2. Any suitable known means may be used to raise or lower the structure; a scissors-jack automatic device 6 connected to a source of power is an easy and convenient way to vertically adjust the structure 3-4. A push button 7 may be positioned on the side of either component 3 or 4 for the use of the wheelchair occupant to automatically raise or lower the component(s) 3 and/or 4. A second button 8 is provided for automatic horizontal or lateral movement. In this FIG. 2 embodiment the user can wheel around the unit to load paper in trays 4, push either button 7 or 8, lift platen cover 9, retrieve copies from collection station 10 or do any functions heretofore difficult to accomplish. When the wheelchair user 2 is finished using the marking system, he or she can conveniently push the button 7 to raise the unit 3-4 to its normal location. While the I.O.T. 3 and the paper trays 4 are shown connected, they can be separate modules each with its own raising and lowering device as shown in FIG. 4B.

Figure 3:
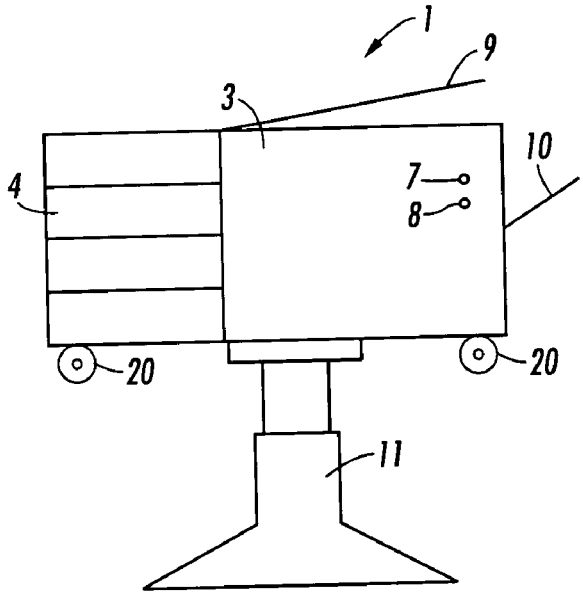
FIG. 3 illustrates a side view of a two module unit with a hydraulic lift-raise and lower adjuster.

In FIG. 3, rather than using a scissors-jack as the automatic device to raise or lower the marking structure 1, a conventional hydraulic lift 11 connected to a source of power can be used, if suitable. The same button 7 is used to raise or lower the marking structure 1. As earlier noted, any suitable vertical mover besides scissors-jack 6 or hydraulic lift 11 may be used. The important aspect is that any and all of the components that make up the marking unit 1 must be adjustable by the wheelchair user to fit his or her specific and individual needs. All of the components of marking system 1 are easily accessible to user 2 by merely working buttons 7 and 8 for the desired vertical and horizontal movement. Obviously, the desired adjustments will vary with the user. Also, by traveling around the system 1, all modules are at a level easily reached by the wheelchair user 2.

Figure 4A:
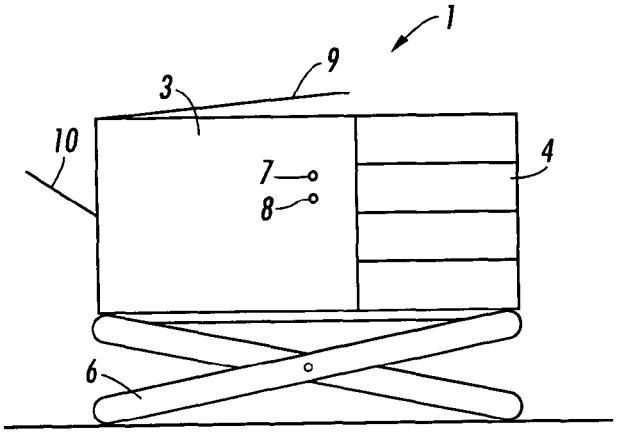
FIG. 4A illustrates a unit comprising at least two modules, an I.O.T. module and paper trays module connected.
Figure 4B:
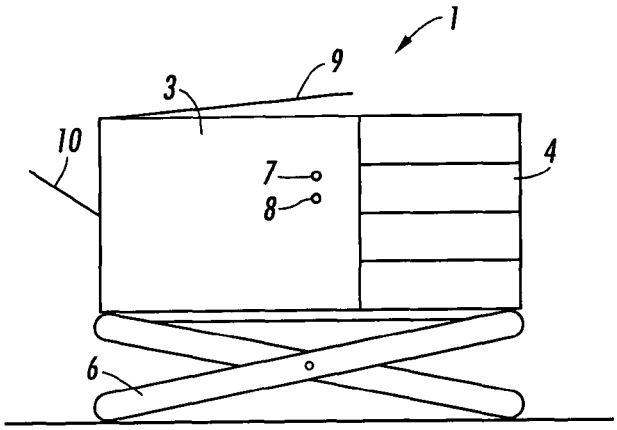
FIG. 4B illustrates a system with at least two modules, an I.O.T. module and paper tray module separated.

In FIG. 4A, a marking system 1 of this invention is shown in a side view having modules 3 and 4 connected and raised by one vertical adjuster 6. FIG. 4B shows these same modules 3 and 4 separated and provided with their own separate vertical adjusters 6.

Figure 5:
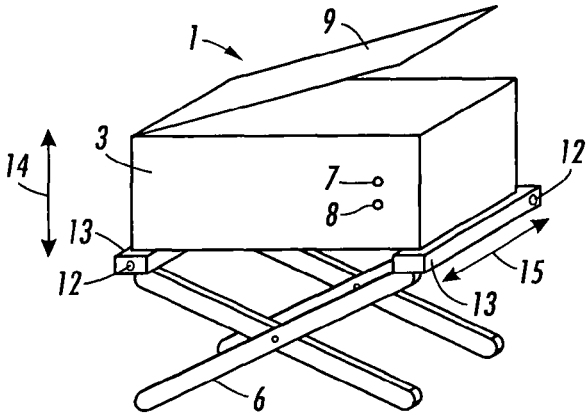
FIG. 5 illustrates a module having both a vertical and horizontal mover.

In FIG. 5, for clarity, only one module 3 is shown, however, all of the modules of embodiments of this invention will have both vertical adjusters 6 and horizontal adjusters 12 with their corresponding push buttons 7 and 8 for easy adjustment. A horizontal adjuster 12 is shown in the form of retractable rails 13 in or on which module 3 moves, however, any suitable horizontal adjuster 12 may be used, such as wheels, etc. The arrows 14 show vertical adjustment and arrows 15 show horizontal adjustment or movement.

Figure 6A:
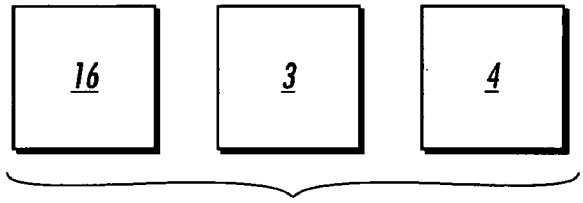
FIG. 6A illustrates an embodiment top view where at least three modules are used in the same plane.
Figure 6B:
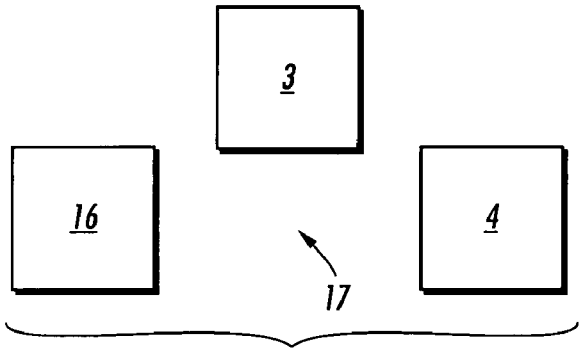
FIG. 6B illustrates an embodiment top view where at least three modules are positioned in a desk-like arrangement.
Figure 6C:
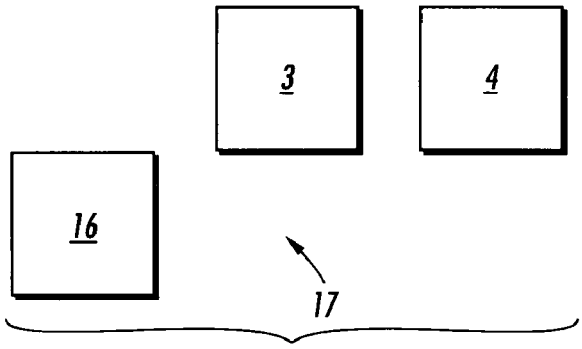
FIG. 6C illustrates a top view of at least three modules, these modules in a varied arrangement.
Figure 7:
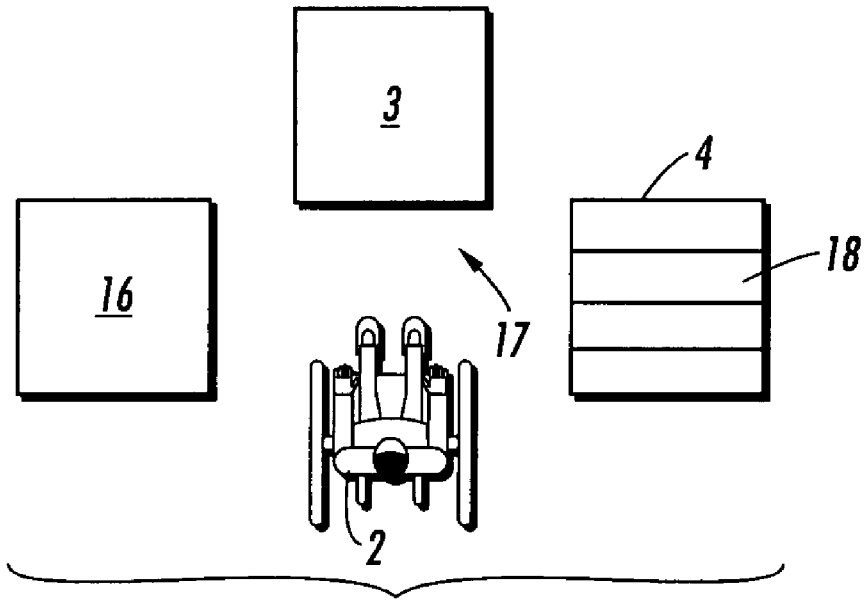
FIG. 7 illustrates a top view of the module desk-like arrangement of FIG. 6B
Figure 8:
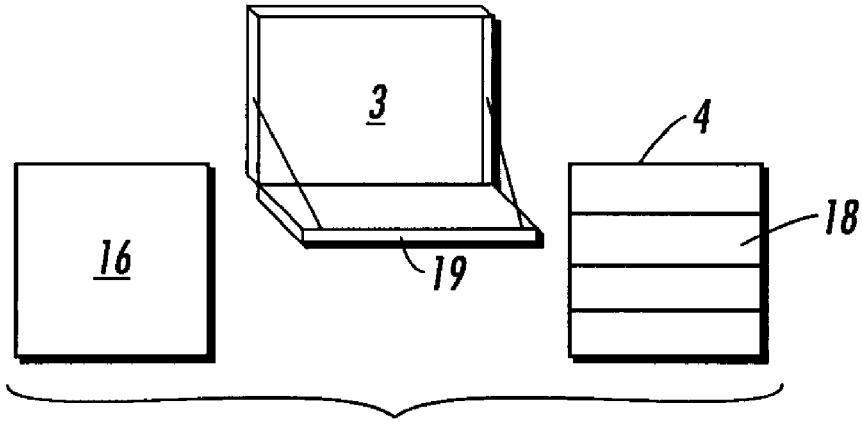
FIG. 8 illustrates a center module with an optional drop-leaf table that provides a working surface to the user.

In FIGS. 6A-6C, top views of any number of modules are shown, but at least three modules. In these Figures, three modules are shown for clarity and ease of description. The center module is designated as the I.O.T. module 3. However, the I.O.T. module can be used in any location of the modules. For these modules to function, they need to be initially separate and each have their own vertical and horizontal adjusters. Each module is enabled to be individually or collectively moved to substantially the same vertical level and to different horizontal locations as shown in FIGS. 6B, 6C and FIG. 7. It is ideal for each module to be at substantially the same desired vertical level selected by the wheelchair user. In 6A, three modules are shown from a top view, the I.O.T. is designated as center module 3, the paper trays as element 4 and element or module 16 is any module such as a finishing station (or any other functioning module.) Any number of these modules may be arranged in any suitable manner. For clarity, I.O.T. module 3 will always be shown in the center. In FIGS. 6B and 6C, a top view of a desk-like arrangement of the modules is shown with the I.O.T.—3 in the center and moved horizontally out of alignment with modules 4 and 16 leaving a space 17 between the modules into which a wheelchair can move. The modules 4 and 16 can be in horizontal alignment as shown in FIG. 6B or can be out of alignment as shown in FIG. 6C. Obviously, any number of modules can be used and arranged in any desirable fashion. If desired, in module 4, the paper trays can be moved so that the paper drawers 18 face outwardly as shown in FIGS. 7 and 8 or they can face pointing inwardly toward the user 2. In FIGS. 7 and 8 paper drawers 18 are not top views but are side views of 18 only for clarity. These side views of the module 4 show paper drawers 18 facing outwardly for easy access. The components other than module 4 in FIGS. 7 and 8 are shown in a top view.

FIG. 7 shows a top view of a desk-like modular arrangement where the wheelchair user 2 locates himself or herself in space 17 and can control each of the modules 3, 4 and 16 by push buttons or activating elements 7 and 8 on each unit 3, 4 and 16. This can be a convenient arrangement for the wheelchair user 2 because all components are conveniently positioned at arms length. As noted earlier, each of the modules 3, 4 and 16 have their own vertical adjuster 6 and horizontal adjuster 12 to place each module in any arrangement. All modules in FIG. 7 except module 4 are shown in a top view; for clarity module 4 is shown in a side view.

If desirable, any or all of the modules 3, 4 and 16 can have an optional drop-leaf table 19 for a writing or working surface.

In summary, in one embodiment of this invention, a marking system such as a xerographic copier or printer is provided comprising in an operative arrangement, at least three components, an image output terminal or processor module, at least one paper tray(s) module and a raising-lowering device. This system, while comprising at least three components, also has at least two modules. The processor module and the paper tray(s) modules are substantially on the same vertical level that is substantially side by side. The raising-lowering device is positioned below the processor and the paper tray(s) and is enabled to raise and lower both the processor and the paper tray(s) to a low position sufficient to provide a wheelchair occupant easy access to the paper trays and the processor.

In another embodiment, the marking system has at least two modules and as a fourth component a horizontally positioning device, the horizontally positioned device is enabled to move the modules laterally as opposed to up and down movement. In some embodiments, the modules are attached to each other and are adapted to move vertically and horizontally as one unit. In other embodiments, the modules are separated and each is enabled to have its own vertical and horizontal moving devices. The raising-lowering device in one embodiment is selected from the group consisting of a scissor-jack, a hydraulic device, and mixtures thereof.

When the system comprises at least three modules, each is enabled to be individually or collectively moved to the same vertical level and to the same or different horizontal locations. When the horizontal positioning device is used, this horizontal positioning device comprises powered wheels retractable rails or a pair of parallel rails upon which each of the modules is laterally movable.

In another embodiment of the system, it comprises at least three modules wherein the processor is enabled to be moved horizontally beyond remaining modules to form a desk-like structure. Here, the processor module is positioned in front of a user and the remaining modules are positioned at the side or sides of a user thereby forming a space there between for a wheelchair to locate. Each module is ideally located at the same vertical plane selected by the user and at the same or different horizontal locations. Thus, various embodiments comprise in an operative arrangement at least four components, an Image output Terminal (I.O.T.) or processor module, at least one paper tray(s) module, a module raising-lowering powered device and a module horizontally positioning device. These modules are enabled to be lowered to substantially the same or different vertical plane by the raising-lowering device as selected by a user. The ideal vertical plane extends from just below a user-s knees (when in a sitting position) to the user's chest. The modules have activating elements such as buttons that are enabled to automatically move the raising-lowering device and the horizontally positioning device.

When the horizontal positioning device is used, the horizontal positioning device comprises in an embodiment a set of parallel retractable rails 13 upon which each of the modules is laterally movable. In another embodiment the horizontal positioning device are powered wheels 20. They should be retractable so that when moved horizontally from position to position, the rails are not extending beyond the module moved.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A marking system comprising in an operative arrangement, at least three components, an image output terminal or processor module, at least one paper tray(s) module and a raising-lower device, and comprising at least two modules, said processor module and said paper tray(s) module being substantially on the same vertical level, that is substantially side by side, said raising-lowering device positioned below said processor module and said paper tray(s) and enabled to raise and lower both said processor module and said paper tray(s) module to a low position sufficient to provide a wheelchair occupant easy access to said paper trays and said processor, and wherein said system comprises at least two modules wherein said processor module is enabled to be moved horizontally beyond remaining module(s) to form a desk-like structure where said processor module is positioned in front of a user and said remaining modules are positioned at the side of a user, thereby forming a space for a wheelchair to locate.

2. The marking system of claim 1 having at least two modules and as a fourth component a horizontally positioning device, said horizontally positioned device enabled to move said modules laterally as opposed to up and down movement.

3. The system of claim 1 wherein said at least two modules are attached to each other and are adapted to move vertically and horizontally as one unit.

4. The system of claim 1 wherein said at least two modules are separated and each enabled to have their own vertical and horizontal moving devices.

5. The system of claim 1 wherein said raising-lowering device is selected from the group consisting of a scissor-jack, a hydraulic device, and mixtures thereof.

6. The system of claim 1 wherein said system comprises at least two modules, each enabled to be individually or collectively moved to the same vertical level and to the same or different horizontal locations.

7. The system of claim 1 wherein a horizontal positioning device is used, said horizontal positioning device comprises rails upon which each of said modules is laterally movable.

8. The marking system comprising in an operative arrangement at least four components, an image output terminal (I.O.T.) or processor module, at least one paper tray(s) module, a module raising-lowering device, and a module horizontally positioning device, said system comprising at least three modules, said modules enabled to be lowered to substantially the same vertical plane by said raising-lowering device as selected by a user, said vertical plane extending from just below a user's knees (when in a sitting position) to said user's chest, said modules having activating elements enabled to automatically move said raising-lowering device and said horizontally positioning device, and wherein said system comprises at least three modules wherein said processor is enabled to be moved horizontally beyond remaining modules to form a desk-like structure where said processor module is positioned in front of a user and said remaining modules are positioned at the side of a user, thereby forming a space for a wheelchair to locate.

9. The system of claim 8 wherein said modules are attached to each other and are adapted to move vertically and horizontally as one unit.

10. The system of claim 8 wherein at least three said modules are separated and each enabled to have their own vertical and horizontal moving devices.

11. The system of claim 8 wherein said raising-lowering device is selected from the group consisting of a scissor-jack, a hydraulic device, and mixtures thereof.

12. The system of claim 8 wherein said system comprises at least three modules, each enabled to be individually or collectively moved to the same vertical level and to the same or different horizontal locations.

13. The system of claim 8 wherein a horizontal positioning device is used, said horizontal positioning device comprises retractable rails upon which each of said modules is laterally movable and wherein said system comprises at least three modules wherein said processor is enabled to be moved horizontally beyond remaining modules to form a desk-like structure where said processor module is positioned in front of a user and said remaining modules are positioned at the side of a user, thereby forming a space for a wheelchair to locate.

14. The system of claim 8 wherein said system is an electrostatic marking system.

* * * * *